United States Patent [19]

Johnson et al.

[11] Patent Number: 5,048,801

[45] Date of Patent: Sep. 17, 1991

[54] SINTERING FURNACE

[75] Inventors: Kenneth P. Johnson, Fallbrook; Charles A. Zwissler, Coronada, both of Calif.

[73] Assignee: Risi Industries, Chula Vista, Calif.

[21] Appl. No.: 379,579

[22] Filed: Jul. 12, 1989

[51] Int. Cl.[5] ..... C21D 1/74

[52] U.S. Cl. ..... 266/256; 266/251; 432/206

[58] Field of Search ..... 266/249, 250, 256, 280, 266/251; 432/198, 199, 200, 206

[56] References Cited

U.S. PATENT DOCUMENTS

| | | | |
|---|---|---|---|
| 1,691,369 | 11/1928 | Baker | 266/252 |
| 1,854,179 | 4/1932 | Chapin | 266/264 |
| 2,020,184 | 11/1935 | Hodson et al. | 266/252 |
| 2,029,176 | 1/1936 | Lindberg | 148/16.5 |
| 2,070,416 | 2/1937 | Sturges | 148/16.5 |
| 2,227,176 | 12/1940 | Berghaus | 419/58 |
| 2,311,350 | 2/1943 | Richardson | 266/252 |
| 2,600,094 | 6/1952 | Cone | 266/252 |
| 2,975,083 | 3/1961 | Engelhard | 148/16.5 |
| 3,198,503 | 8/1965 | Eichelberg et al. | 266/256 |
| 4,113,240 | 9/1978 | Klein | 266/252 |
| 4,165,868 | 8/1979 | Southern | 266/264 |
| 4,168,013 | 9/1979 | King et al. | 266/257 |
| 4,171,126 | 10/1979 | Zahn et al. | 266/250 |
| 4,480,822 | 11/1984 | Mauratelli | 266/256 |
| 4,501,717 | 2/1985 | Tsukamoto et al. | 419/58 |
| 4,687,185 | 8/1987 | Urano et al. | 266/274 |
| 4,850,576 | 7/1989 | Hack et al. | 266/280 |

*Primary Examiner*—S. Kastler

*Attorney, Agent, or Firm*—Gregory O. Garmong

[57] ABSTRACT

A sintering furnace includes an upper housing having a gas permeable insulating enclosure therein, with heating elements within the enclosure, and a lower housing having a hearth against which the insulating enclosure rests. Sweep gas is introduced to the interior of the upper housing, outside of the insulating enclosure. The sweep gas flows through the porous enclosure, past the pieces being sintered to sweep organics away, and out of the enclosure through an organics sink post extending upwardly from the hearth. The sink post is hollow and has openings therein, and is in communication with an external trap and vacuum pump, so that the organic-laden sweep gas is drawn out of the furnace. The insulating enclosure includes a gas barrier having openings therethrough and insulation layers on either side, the openings being sized such that the flow of sweep gas prevents diffusion of organic vapor out of the enclosure into the upper housing.

15 Claims, 3 Drawing Sheets

SINTERING FURNACE

BACKGROUND OF THE INVENTION

This invention relates to the construction of furnaces, and, more particularly, to a furnace for sintering powder materials held together with an organic binder.

Powder metallurgical processing is a technique for manufacturing metal (or ceramic) articles. Powders of metals or ceramics are molded by metal injection molding or pressed into the desired preform shape of the finished article. This preform is heated to a temperature at which the powders bind together, or sinter, either by solid state or liquid phase diffusion. Preparation of parts by sintering has important advantages over casting or machining techniques, which include a highly uniform microstructure, low cost production of large numbers of parts, and little waste when the sintered piece is final machined to a useful article. When the forming and sintering operations are conducted properly, articles produced from powders can have properties superior to those of cast or wrought articles.

The powders are formed into the proper shape of the finished article, but must be held in this "green" or unsintered form until sintering can be completed. An organic-based binder is therefore mixed with the powders prior to pressing or molding, and stays with the powders when they are pressed or molded. The binder acts much like a glue to hold the powders in place until they are heated for the sintering operation. The organic binder must be removed from the powder compacts immediately prior to, or during sintering. If the organic binder remains mixed with the powder, it prevents full densification during sintering and results in reduced mechanical properties of the sintered part.

Most sintering cycles for metal powders having organic binders include a preheat period at relatively low temperature. During the preheat period, the organic binders are vaporized and driven from the powder article. The preheat temperature is selected such that a small amount of solid state sintering occurs as the organic material is driven out, so that the compact holds its shape until sintering can be completed at higher temperature, but not so much sintering occurs that the organic vapor cannot escape through open surface porosity.

This type of sintering procedure is widely practiced, but there is a continuing problem of removing the organic material without fouling the interior of the furnace. Some sintering operations use two furnaces, one operating at low temperature to remove the organic material and a second sintering furnace operating at high temperature to effect sintering of the article. Other furnaces use a high gas flow of a sweep gas to flush the organic vapor from the furnace during its evolution. Other furnaces are designed to be easily cleaned, and conduct the sintering without concern for evolution of the organic vapors. However, all of the existing sintering furnaces suffer from an inability to handle high organic loadings, while remaining clean, and an inability to prevent redeposition of the organic material upon the sintered article during and after the sintering process.

There is a need for an improved furnace that permits sintering at high temperatures of 2000° F. and greater, but also can handle high organic loadings during the vaporization of the binder in the preheating step. The present invention fulfills this need, and further provides related advantages.

SUMMARY OF THE INVENTION

The present invention provides a sintering furnace that is operable at temperatures well above 2000° F. The furnace can remove a large organic vapor loading during preheating prior to sintering, while avoiding contamination of the furnace by the organic vapor. The organic vapor is trapped and removed, and none can escape from the furnace or redeposit upon the sintered piece. The furnace is highly versatile, can be operated over a wide range of preheat and sintering cycles, and is designed to attain maximum utilization of the expensive furnace components.

In accordance with the invention, a sintering furnace comprises a bell, including an upper housing having a downwardly facing sealing rim at the periphery, an insulating enclosure supported from the upper housing, the enclosure being porous to gas flow therethrough; a base, including a lower housing having an upwardly facing sealing rim at the periphery, the housing being dimensioned such that the downwardly facing sealing rim of the upper housing is in facing engagement with the upwardly facing sealing rim of the lower housing, to form a gas-tight seal, and a hearth against which the insulating enclosure rests, a gas evacuation line extending upwardly into the interior of the enclosure; and means for introducing a flow of a sweep gas into the furnace outside the insulating enclosure, and removing the flow of sweep gas through the evacuation line.

The sintering furnace of the invention is particularly suited for batch processing of powder parts that have been consolidated with an organic binder. The furnace provides for a flow of a sweep gas through the furnace chamber during at least the preheat portion of the sintering treatment, to remove the organic vapors as they are emitted. The outer housing of the furnace is preferably water cooled, to protect it from overheating. Within the housing are the hearth and the insulating enclosure that, together, form an interior chamber which contain and prevent the organic vapors from condensing upon the cooled walls of the housing. The sweep gas flows through the walls of the enclosure, past the parts that emit the organic vapors, and into the gas evacuation line for removal from the furnace.

The sintering furnace has been structured to provide maximum use of the heating elements and insulating enclosure, the most expensive components. In many furnaces, most of the components are placed within the lower housing for ease of construction and access. In the present furnace, the expensive components are placed within the upper housing of the bell. Multiple lower housings can be furnished, so that the upper housing can be moved from lower housing to lower housing, as needed. For example, two lower housings may be provided for use with a single upper housing. The upper housing is placed upon one of the lower housings for a sintering operation, while the other lower housing is open for removal of previously sintered pieces and reloading of a new set of green pieces to be sintered. When the sintering run on the first lower housing is complete, the upper housing is moved to the second lower housing for its sintering run.

Prevention of condensation of the organic vapors on or within the porous enclosure is necessary so that the enclosure does not become clogged with the condensed organic material. In accordance with a preferred approach, an insulating enclosure for use in a furnace that produces condensable contaminants within the enclosure during operation at a preselected temperature, and in which the contaminants are swept away with a preselected flow volume of purge gas comprises a gas barrier having a plurality of openings therethrough, the total area of the openings being such that the flow rate of the preselected flow volume of the purge gas therethrough is greater than the diffusion rate of the condensable contaminants, the gas barrier being made of a material whose operating temperature is greater than the condensation temperature of the contaminants; and a layer of interior insulation over the interior surface of the gas barrier, the insulation being of sufficient thickness that the temperature of the inner surface of the gas barrier is maintained below its operating temperature but above the condensation temperature of the contaminants, when the furnace is operated at the preselected temperature.

In a less preferred approach, the gas barrier with openings therein can be placed interiorly of the insulation. In this case, organic vapor cannot reach the insulation, but the gas barrier must be capable of withstanding a higher temperature than is the case with the preferred approach. In either case, the use of a gas barrier with a carefully selected total opening size permits a regulated flow of sweep gas and simultaneously prevents condensation of organics within the insulation.

The present invention provides an advance in the art of practical sintering furnaces. The furnace of the invention avoids contamination of the furnace using a sweep gas flow approach. Maximum utilization of the expensive components is achieved by placing them in the movable bell. The furnace is operable over a wide range of binder vaporization and sintering cycles. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

In accordance with a preferred embodiment of the invention, a sintering furnace comprises a base, including a water cooled lower housing having an upwardly facing sealing rim at the periphery, a hearth supported within the lower housing, a hollow organic sink post extending upwardly from the hearth, the sink post having openings therethrough so that gas may flow from the exterior of the post to the interior of the post, and at least one shelf supported adjacent the post, the shelf being made of a thermally conductive material; a bell, including a water cooled upper housing having a downwardly facing sealing rim at the periphery, the housing being dimensioned such that the downwardly facing sealing rim of the upper housing is in facing engagement with the upwardly facing sealing rim of the lower housing, to form a gas-tight seal, a sweep gas flow line extending from the exterior to the interior of the upper housing, an insulating enclosure support extending inwardly from the upper housing, an insulating enclosure supported on the insulating enclosure support, the enclosure being constructed to be porous to sweep gas flow, a heating element supported within the insulating enclosure; and means for introducing a flow of a sweep gas into the furnace through the gas flow line, and removing the flow of sweep gas through the hollow post.

Figure 1:
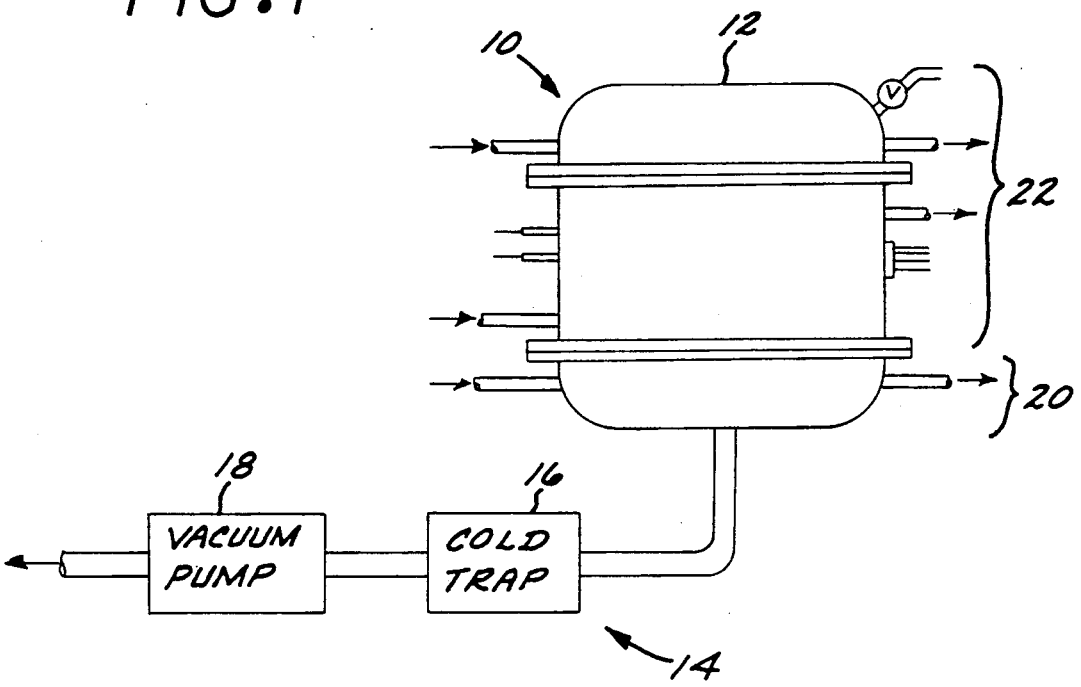
FIG. 1 is a side elevational view of a sintering furnace in accordance with the invention, together with a pictorial representation of related apparatus.
Figure 2:
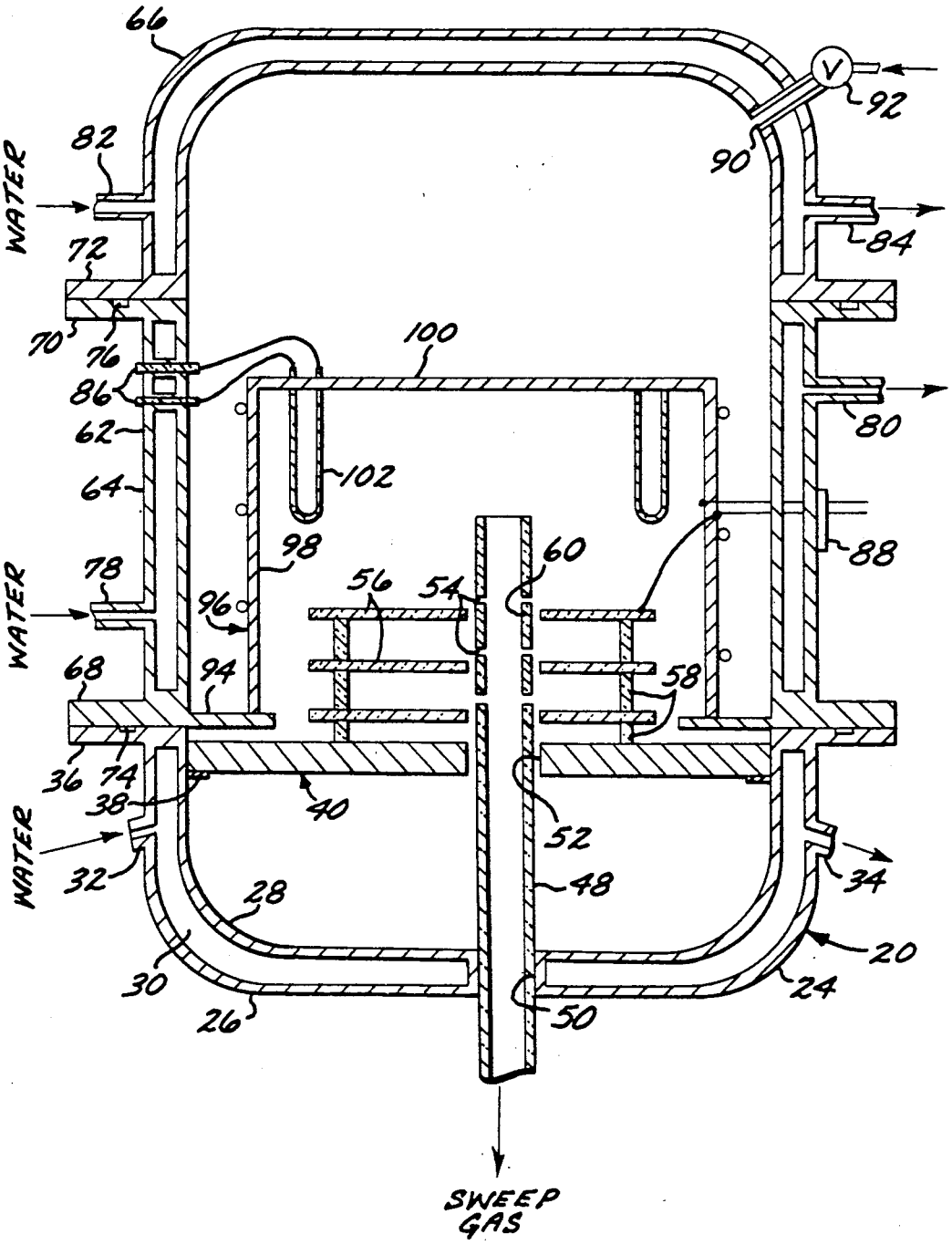
FIG. 2 is a side sectional view of the furnace of FIG. 1.

Referring to FIG. 1, a sintering system 10 includes a sintering furnace 12 with several inlets and outlets, and a sweep gas exhaust system 14, which includes a cold trap 16 and a vacuum pump 18. The furnace 12 is illustrated in a more detailed sectional view in FIG. 2.

The sintering furnace 12 has a base 20 and a bell 22 that seals to the base. The base 20 includes a lower housing 24 that is water cooled. Water cooling is accomplished by making the lower housing double walled, with an outer wall 26 and an inner wall 28, and a cooling water volume 30 therebetween. A cooling water inlet 32 and a cooling water outlet 34 provide a continuous flow of cooling water to the cooling water volume 30. At its upper end, the housing 24 has a flange 36 that permits it to be joined to the bell 22.

A hearth support 38 extends inwardly from the inner wall 28 near the top of the lower housing 24. A ceramic hearth 40 sits upon, and is supported by, the support 38.

A hollow post 48, preferably made of mullite, extends upwardly through a gas-tight aperture 50 in the center of the lower housing 24 and an aperture 52 in the hearth 40. The interior of the post 48 communicates at its lower end with the sweep gas exhaust system 14. At its upper end, the post 48 extends above the hearth 40. Along the length of that portion of the post 48 reaching above the hearth 40, there are a plurality of openings 54, through which gas may flow from the exterior of the post to its interior, and thence to the sweep gas exhaust system.

Several shelves 56 are supported from the top surface of the hearth 40. The shelves 56 may be stacked one upon the other with a series of spacers 58. The shelves 56 are made with apertures 60 in the centers so that they fit around the post 48. The shelves are preferably made of a material that withstands high temperatures and also has good thermal conductivity, and graphite is the preferred material of construction.

The bell 22 includes an upper housing 62 that is double walled and cooled in the same matter as described for the lower housing 24. In the illustrated preferred embodiment, the upper housing 62 is formed of two parts, a cylindrical portion 64 and a dome 66. The cylindrical portion 64 has a flange 68 at the lower end thereof, dimensioned to facingly engage the flange 36 of the lower housing 24. The cylindrical portion 64 has a flange 70 at its upper end, and the dome 66 has a flange 72 at its lower end, the flanges 70 and 72 being dimensioned to facingly engage each other. One of the flanges 36 and 68 has an O-ring groove 74 on the facing surface, and one of the flanges 70 and 72 has an O-ring groove 76 on the facing surface. The O-ring grooves 74 and 76 contain O-rings that seal the flanges together, to make the sintering furnace 12 gas tight when closed.

There are several feedthroughs in the upper housing 62. There are a cooling water inlet 78 and a cooling water outlet 80 in the cylindrical portion 64, and a cooling water inlet 82 and a cooling water outlet 84 in the dome 66. A high current electrical vacuum feedthrough 86 conducts power for heating elements into the interior of the sintering furnace 12. An instrumentation feedthrough 88 conducts leads for instrumentation such as thermocouples into the interior of the sintering furnace 12. A sweep gas inlet line 90 brings sweep gas into the interior of the sintering furnace 12, as regulated by a valve 92.

An insulating enclosure support 94 extends inwardly from the cylindrical portion 64, near its lower end adjacent the flange 68. An insulating enclosure 96 stands upon, and is supported by, the support 94. The enclosure 96 has a generally cylindrical wall 98 and a top 100, and resembles an inverted can. The insulating enclosure 96 is made of a gas-porous construction, as will be discussed below in relation to FIG. 3. Heating elements 102 are hung from the top 100 of the enclosure, and connected by cables to the power feedthrough 86. The heating elements are preferably made of molybdenum disilicide. Other types of elements such as carbon or metallic resistance wires could be used where they meet the temperature requirements and where their presence does not interfere with the sintering process.

In operation, parts to be sintered are placed upon the shelves 56. A sweep gas such as nitrogen or an inert gas is introduced into the interior of the upper housing 62 through the sweep gas inlet line 90. The sweep gas flows through the porous walls of the enclosure 96 and past the parts being processed. During that portion of the thermal cycle wherein organic vapors are evolved from the parts being sintered, these vapors are entrained in the sweep gas. The sweep gas is drawn toward the openings 54 in the post 48, under the influence of the vacuum being drawn on the bottom of the post 48 by the vacuum pump 18. The organic-laden sweep gas flows into the post and into the cold trap, where the organic vapors are condensed for recovery. After the organic binder is depleted from the parts and organic vapor is no longer being evolved, the flow of sweep gas may be discontinued, and sintering completed in a selected atmosphere or in vacuum.

Figure 3:
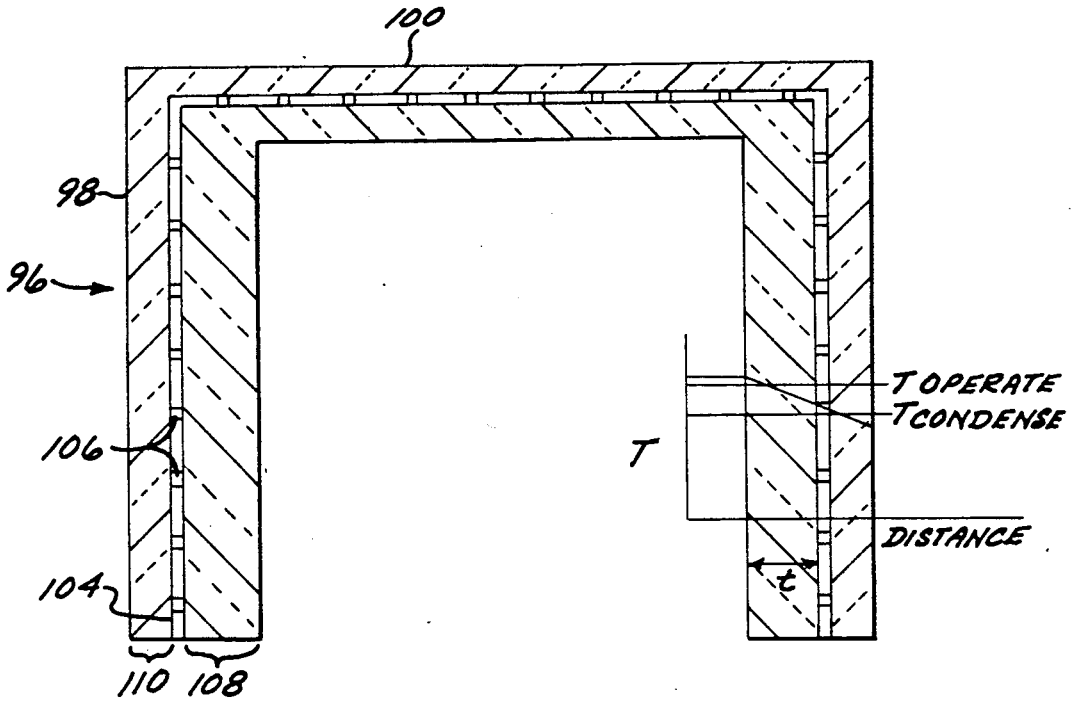
FIG. 3 is a side sectional view of a preferred embodiment of an insulating enclosure.

The preferred construction of the enclosure 96 is illustrated in FIG. 3. The enclosure includes a gas barrier 104 having a plurality of openings 106 therethrough. The gas barrier 104 is of the same cylindrical configuration, closed at one end, as has been described for the enclosure generally. The gas barrier is preferably made of a metal, such as stainless steel, about 1/10–⅛inch thick. A layer of interior insulation 108 is provided along the inside of the gas barrier 104. The insulation is preferably a porous ceramic wool. Optionally, a layer of exterior insulation 110 is provided along the outside of the gas barrier 104. The exterior insulation 110 is also made of a porous material such as a porous ceramic wool.

The construction of the insulating enclosure 96 is selected to permit the flow of sweep gas, but to avoid clogging of the insulation by condensing organic vapors. If the insulating enclosure had nothing more than a layer of porous insulation material, the flow of sweep gas would have to be very high, so that organic vapors could not diffuse upstream into the insulation. If the organic vapors did diffuse upstream, they would condense at the strata of the insulation layer where the temperature fell below the condensation temperature of each organic component. If the entire insulation layer were above the condensation temperature, then organic vapors could diffuse entirely through the insulation layer and condense on the cold interior walls of the upper housing 62. Both of these situations are undesirable. Condensation within the insulation layer would obstruct and eventually block the flow of sweep gas. Condensation of organic vapor within the insulation or on the housing walls would require expensive cleanup at periodic intervals. Condensed organic material that had not been removed might re-evaporate during the sintering cycle, contaminating the sintered parts.

The design of FIG. 3, using the gas barrier 104, prevents upstream diffusion of the organic vapor and its condensation in the insulation or the interior walls of the upper housing 62. The total area of the openings 106 is calculated to be such that the flow of a preselected volumetric flow rate of sweep gas therethrough is greater than the upstream diffusion rate of the organic vapor. The organic vapor therefore cannot diffuse upstream sufficiently rapidly to pass through the openings 106, and is contained within the interior of the gas barrier 104. Since the applied vacuum draws the sweep gas toward the post 48, eventually the organic vapors must be drawn toward the post 48 and out of the sintering furnace 12.

In the present design, for organic vapor evolution at temperatures of 1200° F. or less, the maximum diffusion velocity of the vapor is about 25 feet per second. The selected gas flow rate of the sweep gas is 3.4 cubic feet per second. The total area of the openings 106 is 2.0 square inches. After adjusting for pressure differences, the inward flow rate of the sweep gas through the openings is about 245 feet per second, a rate much greater than the outward flow rate of the organic vapor. The organic vapor cannot escape through the openings.

The thickness of the layer of interior insulation 108 is selected to prevent condensation of the organic vapors within the layer of interior insulation, and to protect the material of the gas barrier against degradation by the heat of sintering. If the layer of interior insulation is too thin, the material of the gas barrier 104 may be heated to a temperature greater than its acceptable operating temperature. If the layer of interior insulation is too thick, the temperature deep within the layer of interior insulation may be reduced so low that the organic vapors can condense within the insulation layer.

A schematic graph of temperature T as a function of distance through the insulating enclosure 96 is shown as an inset in FIG. 3. Within the interior of the enclosure 96, the temperature is high, but it decreases with increasing depth into the insulation. The thickness t of interior insulation 108 is sufficiently great that the temperature at the inner surface of the gas barrier 104 is below its preselected acceptable operating temperature ($T_{operate}$), which is known for typical materials of construction. The thickness t of interior insulation 108 is sufficiently small that the temperature at the inner surface of the gas barrier 104 is not reduced so low that it is below the condensation temperature of the organic vapor ($T_{condense}$).

In the preferred operating case, $T_{operate}$ of type 304 stainless steel used in the gas barrier is about 1000° F. $T_{condense}$ is about 300° F. The temperature gradient produced by the preferred ceramic wool insulating material is about 560° F. per inch. Therefore, from about 1.5 to about 2.0 inches of insulation is used in the interior insulating layer 108. The preferred thickness is 2.0 inches.

An important feature of the construction of the sintering furnace 12 is that most of the expensive components have been supported from the interior of the upper housing 62. These expensive components include the heating elements and the insulating enclosure. The components contained within the lower housing 24 are, by contrast, relatively inexpensive. This arrangement of components is adopted to permit the maximum utilization of the expensive components.

Figure 4:
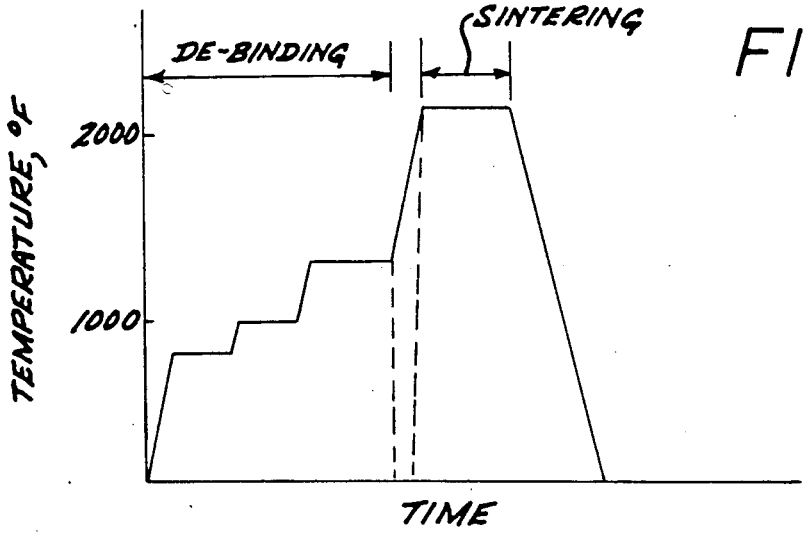
FIG. 4 is a schematic graph of temperature as a function of time for a sintering operation.

FIG. 4 shows a typical de-binding and sintering heat treatment profile for the sintering furnace, when the parts being sintered are made of a nickel-iron alloy and the binder contains polypropylene. To accomplish vaporization and removal of the binder in the de-binding portion of the treatment, the parts are first heated to 750° F. for one hour, then to 950° F. for one hour, and finally to 1200° F. for one hour, at which point the organic binder has been fully driven from the system. The treatment could then proceed to the sintering temperature of 2300° F. for one hour, as indicated by the solid lines in FIG. 4. The sintering furnace 12 illustrated in FIGS. 1 and 2 would be used for both the de-binding and sintering treatments.

Alternatively, after the final portion of the de-binding treatment at 1200° F., the furnace could be cooled to ambient temperature and the bell 22 replaced with a different bell, and then reheated. This path corresponds to the dashed lines in FIG. 4. For example, the upper housing used to 1200° F. would not be water cooled, and low temperature heaters would be used. The housing used for sintering at 2300° F. would be of the illustrated double-jacketed construction, but the insulating enclosure would not have a gas barrier because further evolution of organic vapor would not occur after de-binding was complete.

Figure 5:
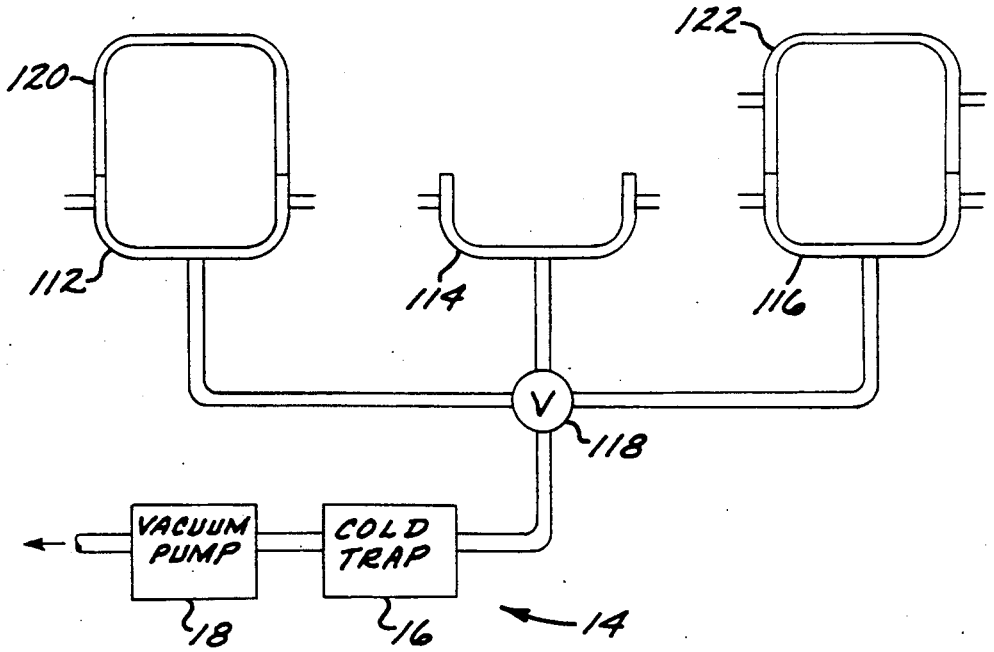
FIG. 5 is a schematic view of an operating furnace system using three lower housings and two upper housings.

The use of different, movable upper housings with fixed lower housings is illustrated in FIG. 5, which depicts three fixed lower housings and two movable upper housings. Each of the lower housings 112, 114, and 116 is water cooled and communicates through a valve 118 with the sweep gas exhaust system 14. One of the upper housings 120 is not water cooled, and limited to operation at a maximum temperature of 1200° F. The other upper housing 122 is water cooled and can operate up to the maximum sintering temperature, here 2300° F.

Maximum utilization of the expensive upper housings 120 and 122 is achieved as follows. At the moment illustrated in FIG. 5, one of the lower housings 114 is being emptied of finished parts and reloaded with unsintered parts. This operation typically requires about 4 hours. The lower housing 112 is used in a de-binding operation, using the low-temperature upper housing 120, which typically requires about 4 hours. During this de-binding operation, the lower housing 112 is placed in communication with the sweep gas exhaust system 14 by correct placement of the valve 118, as a large volume of organic vapor is produced during the de-binding operation. The lower housing 116 is used in a sintering operation, using the high-temperature, sintering upper housing 122. This operation requires about three hours. When each of the three operations, loading, de-binding, and sintering, is complete, the high-temperature upper housing 122 is moved to the lower housing 112, the low-temperature upper housing is moved to the lower housing 114, and the lower housing 116 is open for removal of finished parts and reloading. Thus, each of the upper housings 120 and 122 is fully utili ·ed for its intended design purpose through continual reshuffling of the upper housings to the proper lower housings.

The present invention provides an advance in the art of sintering furnaces for use in the de-binding and sintering of powder mixtures bound with organic binders. Although a particular embodiment of the invention has been described in detail for purposes of illustration, various modifications may be made without departing from the spirit and scope of the invention. Accordingly, the invention is not to be limited except as by the appended claims.

What is claimed is:

1. A sintering furnace, comprising:

a bell, including an upper housing having a downwardly facing sealing rim at the periphery, an insulating enclosure supported from the upper housing, the enclosure being porous to gas flow therethrough;

a base, including a lower housing having an upwardly facing sealing rim at the periphery, the housing being dimensioned such that the downwardly facing sealing rim of the upper housing is in facing engagement with the upwardly facing sealing rim of the lower housing, to form a gas-tight seal, and a hearth against which the insulating enclosure rests, a gas evacuation line extending upwardly into the interior of the enclosure; and means for introducing a flow of a sweep gas into the furnace outside the insulating enclosure, and removing the flow of sweep gas through the evacuation line.

2. The furnace of claim 1, wherein the means for introducing includes a gas flow line through the upper housing and a valve to regulate the flow of gas therethrough.

3. The furnace of claim 1, wherein the means for introducing includes a vacuum pump and cold trap communicating with the interior of the hollow post.

4. The furnace of claim 1, wherein the bell further includes a heating element within the interior of the enclosure.

5. The furnace of claim 1, wherein the base further includes a shelf supported from the hearth.

6. The furnace of claim 1, wherein the enclosure includes a gas barrier having openings therethrough to permit gas flow.

7. The furnace of claim 6, wherein the total area of the openings is such that the flow rate of a preselected flow volume of a sweep gas therethrough is greater than the diffusion rate of condensable contaminants produced within the enclosure during operation of the furnace, thereby preventing the escape of the contaminants outwardly through the gas permeable enclosure.

8. The furnace of claim 6, wherein the gas barrier has a layer of insulation on the interior thereof.

9. The furnace of claim 1, wherein the insulating enclosure has a bakeout heater on the exterior surface thereof.

10. The furnace of claim 1, wherein the hearth, the lower housing, and the upper housing are water cooled.

11. The furnace of claim 1, further including an organic removal heating element supported within the interior of the insulating enclosure of the bell, the organic removal heating element being operable at an organic removal temperature at which volatile organic materials are removed from the powdered materials being processed, and further including a second bell dimensionally interchangeable with the bell, the second bell including a water cooled housing having a downwardly facing sealing rim at the periphery, and a sintering heating element supported from the interior of the housing, the sintering heating element being operable at the sintering temperature of the powdered materials being processed.

12. A sintering furnace, comprising:

a base, including a water cooled lower housing having an upwardly facing sealing rim at the periphery, a hearth supported within the lower housing, a hollow organic sink post extending upwardly from the hearth, the sink post having openings therethrough so that gas may flow from the exterior of the post to the interior of the post, and at least one shelf supported adjacent the post, the shelf being made of a thermally conductive material;

a bell, including a water cooled upper housing having a downwardly facing sealing rim at the periphery, the housing being dimensioned such that the downwardly facing sealing rim of the upper housing is in facing engagement with the upwardly facing sealing rim of the lower housing, to form a gas-tight seal, a sweep gas flow line extending from the exterior to the interior of the upper housing, an insulating enclosure support extending inwardly from the upper housing, an insulating enclosure supported on the insulating enclosure support, the enclosure being constructed to be porous to sweep gas flow, a heating element supported within the insulating enclosure; and means for introducing a flow of a sweep gas into the furnace through the gas flow line, and removing the flow of sweep gas through the hollow post.

13. The furnace of claim 1, wherein the insulating enclosure comprises a gas barrier having a plurality of openings therethrough, the total area of the openings being such that the flow rate of a preselected flow volume of the purge gas therethrough is greater than the diffusion rate of the condensable contaminants, the gas barrier being made of a material whose operating temperature is greater than the condensation temperature of the contaminants; and a layer of interior insulation over the interior surface of the gas barrier, the insulation being of sufficient thickness that the temperature of the inner surface of the gas barrier is maintained below its operating temperature but above the condensation temperature of the contaminants, when the furnace is operated at a preselected temperature.

14. The furnace of claim 13, wherein the insulating enclosure further includes a layer of insulation over the exterior of the gas barrier.

15. The furnace of claim 1, wherein the insulating enclosure is formed as a metal gas barrier having a plurality of discrete openings therethrough.

* * * * *